United States Patent [19]

Elinski

[11] Patent Number: 4,732,387

[45] Date of Patent: Mar. 22, 1988

[54] DISPENSING CONTAINER

[76] Inventor: Joseph C. Elinski, 3304 S. Keswick Plz., Philadelphia, Pa. 19114

[21] Appl. No.: 97,152

[22] Filed: Sep. 16, 1987

[51] Int. Cl.[4] ..... A63F 9/00

[52] U.S. Cl. ..... 273/144 A

[58] Field of Search ..... 273/144

[56] References Cited

U.S. PATENT DOCUMENTS

| | | | |
|---|---|---|---|
| 1,981,581 | 11/1934 | Burn | 273/144 A |
| 2,187,046 | 1/1940 | McLean | 273/144 A |
| 2,731,268 | 1/1956 | Raizen | 273/144 A |
| 2,902,284 | 9/1959 | Massaro | 273/144 A |
| 3,232,621 | 2/1966 | Michelson | 273/144 A |
| 4,402,512 | 9/1983 | Joseph | 273/144 A X |

FOREIGN PATENT DOCUMENTS

| | | | |
|---|---|---|---|
| 2366854 | 6/1978 | France | 273/144 B |
| 2408181 | 7/1979 | France | 273/144 A |
| 2436614 | 5/1980 | France | 273/144 A |
| 899630 | 6/1962 | United Kingdom | 273/144 A |
| 1418690 | 12/1975 | United Kingdom | 273/144 B |

*Primary Examiner*—Paul E. Shapiro

*Attorney, Agent, or Firm*—Jerry T. Kearns

[57] ABSTRACT

A hollow spherical container for use in randomly selecting lottery numbers may be formed from a transparent plastic material. The container may be formed by two hemispheres joined together by interfitting portions. A plurality of numbered elements are contained within the hollow sphere. These elements may be either numbered spherical balls or numbered cylindrical disks. An aperture in the container is provided for randomly dispensing the numbered elements. A mechanism for dispensing the numbered elements one at a time is provided.

8 Claims, 4 Drawing Figures

DISPENSING CONTAINER

BACKGROUND OF THE INVENTION

1. Field of the Invention

The present invention relates to dispensing containers, and more particularly pertains to a new and improved dispensing container for use in randomly selecting lottery number. Several states have instituted lotteries for purposes of raising revenues. One type of state lottery is in the form of a game in which each contestant picks a series of numbers and pays a fee for each series of numbers selected. The combined fees from the lottery players forms a prize fund. When the entry period for the particular lottery is closed, the state lottery organization randomly selects a series of numbers. Contestants whose numbers match all, or several of these numbers will share in the prize fund. The present invention is directed towards a device for randomly selecting a series of numbers for use in the play of this type of lottery.

2. Description of the Prior Art

Various types of dispensing containers are known in the prior art. A typical example of such a dispensing container is to be found in U.S. Pat. No. 840,934, which issued to J. Grant on Jan. 8, 1907. This patent discloses a bottle shaped dispensing container for use in playing a baseball game. A plurality of variously inscribed balls are received in the container. The container has a reduced diameter neck portion for dispensing only one of the plurality of balls at a time. The inscription on the dispensed ball determines the course of play of the game. U.S. Pat. No. 914,655, which issued to T. Glenn on Mar. 9, 1909, discloses a cup shaped dispensing container in which a plurality of variously numbered balls are received. A series of pockets formed in the interior of the dispensing container are dimensioned so as to allow passage of only a single ball at a time out through an aperture in the dispensing container. U.S. Pat. No. 974,970, which issued to F. Iorio on Nov. 8, 1910, discloses a container for dispensing numbered balls. A box like receptacle is provided with an inclined bottom on which a plurality of variously numbered balls are received. These balls roll into a trough like depression in the bottom of the receptacle and are dispensed one at a time through an aperture in the bottom of the container. A slide element is provided on the outer surface of the container for dispensing the balls one at a time. U.S. Pat. No. 1,486,690, which issued to P. Scheliga on Mar. 11, 1924, discloses a device for randomly dispensing one of a plurality of variously numbered balls. The device includes an upstanding standard which has a reduced diameter portion having a cup shaped depression on an upper end surface thereof. A vertically movable container surrounds the upstanding standard and by axially reciprocating the container along the standard, variously numbered balls may be sequentially dispensed. U.S. Pat. No. 1,562,197, which issued to J. Andrew on Nov. 17, 1925, discloses a similar device. A plurality of variously numbered balls are received in a container. The container has coaxial top and bottom openings. A plunger having a cup shaped depression is received in the bottom opening of the container. By reciprocating the container axially along the plunger, a single numbered ball is dispensed through the top opening in the container. A coil spring received around the plunger biases the container axially upwards. U.S. Pat. No. 1,685,183 which issued to H. Wilhelm on Sept. 25, 1928, discloses a dispensing container for dispensing circular disks one at a time. A box like receptacle has a bottom wall with an aperture sized to receive a circular disk. A slide element has a pocket adapted for registry with the aperture in the bottom wall. The slide element pocket is dimensioned so as to receive only one of the circular disks at a time. By reciprocating the slide elements out of registry with the aperture in the bottom wall of the receptacle, a single disk is dispensed. U.S. Pat. No. 1,981,581, which issued to L. Burn on Nov. 20, 1934, discloses a rotary drum for randomly dispensing spherical elements. U.S. Pat. No. 2,349,623, which issued to J. Hickey on May 23, 1944, discloses a similar rotary drum device for mixing and dispensing spherical elements.

While the above mentioned devices are suited for their intended usage, none of these devices provides a spherical hand held container for randomly dispensing lottery ticket numbers. Further, none of the aforesaid devices provides a spherical random number dispenser which dispenses numbered elements one at a time. Also, none of the previously described devices discloses a random number selecting device for use in selecting lottery numbers which resembles a crystal ball. Additionally, none of the aforesaid prior art devices may be utilized for dispensing either circular disks or spherical balls. Inasmuch as the art is relatively crowded with respect to these various types of dispensing containers, it can be appreciated that there is a continuing need for and interest in improvements to such dispensing containers, and in this respect, the present invention addresses this need and interest.

SUMMARY OF THE INVENTION

In view of the foregoing disadvantages inherent in the known types of dispensing containers now present in the prior art, the present invention provides an improved dispensing container. As such, the general purpose of the present invention, which will be described subsequently in greater detail, is to provide a new and improved dispensing container which has all the advantages of the prior art dispensing containers and none of the disadvantages.

To attain this, a representative embodiment of the concepts of the present invention is illustrated in the drawings and makes use of a hollow spherical transparent container. Further, the invention makes use of a plurality of variously numbered circular disks or spherical balls which are received within the spherical container. Also, the present invention contemplates the use of two hemispherical shells provided with engaging interfitting portions for forming the hollow spherical container. Another feature of the present invention is the provision of a pivotal door arrangement for selectively dispensing the numbered elements one at a time. A further feature of the present invention is the use of a construction which permits the alternative use of either numbered circular disks or spherical balls.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved dispensing container which has all the advantages of the prior art dispensing containers and none of the disadvantages.

It is another object of the present invention to provide a new and improved dispensing container which may be easily and efficiently manufactured and marketed.

It is a further object of the present invention to provide a new and improved dispensing container which is of a durable and reliable construction.

An even further object of the present invention is to provide a new and improved dispensing container which is susceptible of a low cost of manufacture with regard to both materials and labor, and which accordingly is then susceptible of low prices of sale to the consuming public, thereby making such dispensing containers economically available to the buying public.

Still yet another object of the present invention is to provide a new and improved dispensing container which provides in the apparatuses and methods of the prior art some of the advantages thereof, while simultaneously overcoming some of the disadvantages normally associated therewith.

Still another object of the present invention is to provide a new and improved dispensing container in the form of a transparent spherical ball.

Yet another object of the present invention is to provide a new and improved dispensing container which is provided with a pivotal door arrangement for dispensing numbered elements one at a time.

Even still another object of the present invention is to provide a new and improved dispensing container which may utilize either numbered circular disks or numbered spherical balls.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
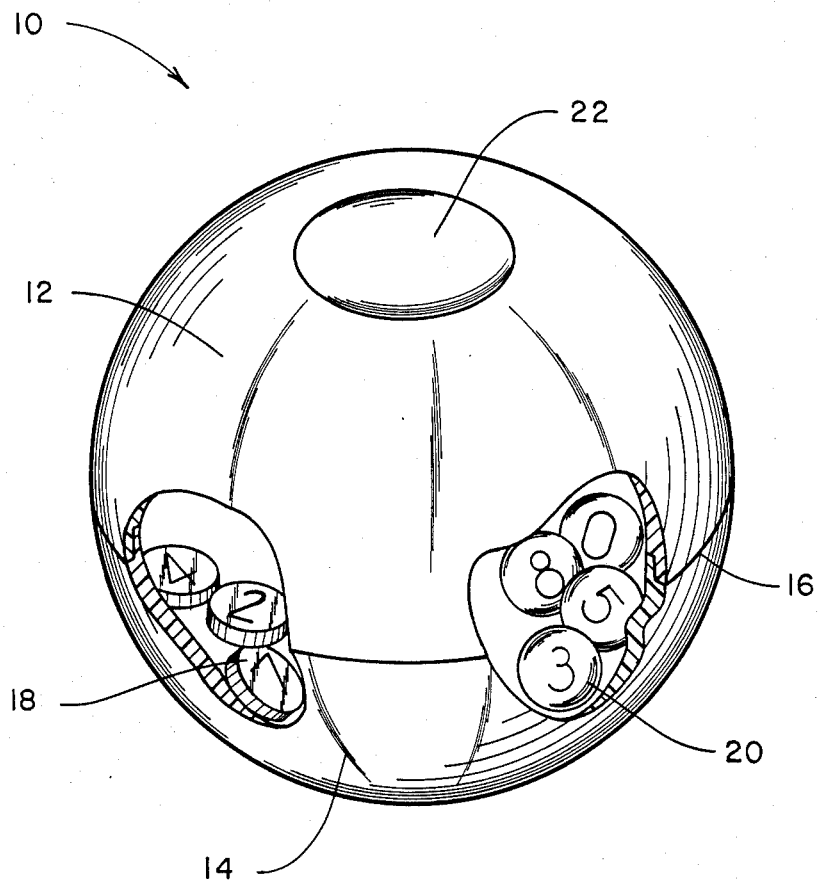
FIG. 1 is a perspective view of the dispensing container of the present invention, partially cut away to illustrate the alternative numbered circular disk and numbered spherical balls.

With reference now to the drawings, and in particular to FIG. 1 thereof, a new and improved dispensing container embodying the principles and concepts of the present invention and generally designated by the reference numeral 10 will be described.

More specifically, it will be noted that the first embodiment 10 of the invention includes a pair of interfitting hemispherical shells 12 and 14 joined at 16. A plurality of numbered elements are received in the interior of the dispensing container. These numbered elements may comprise either circular numbered disks 18 or numbered spherical balls 20. An aperture 22 is provided through the wall of the hemispherical shell 12 for dispensing these numbered elements.

Figure 2:
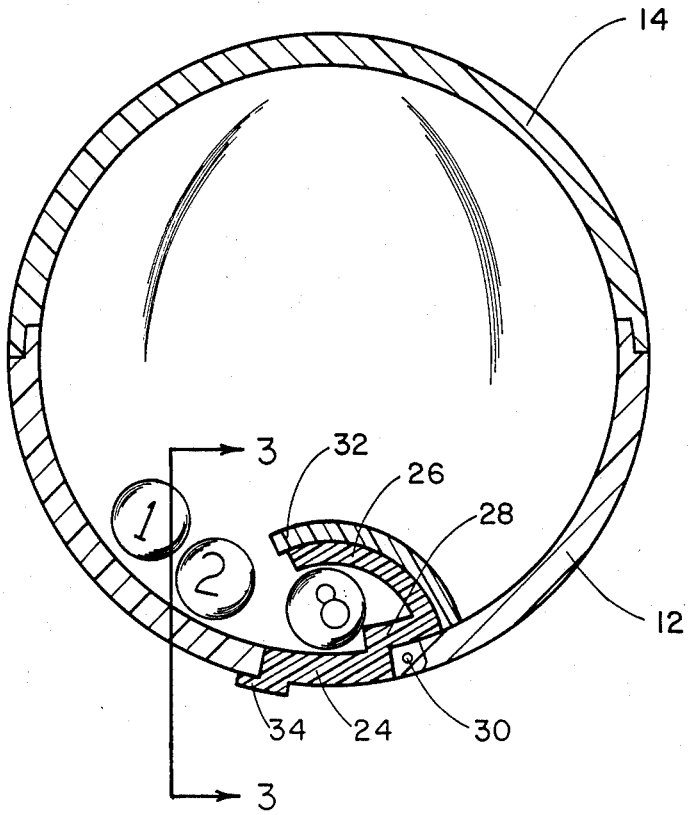
FIG. 2 is a cross sectional view of the dispensing container of FIG. 1, in an inverted position, illustrating the pivotal door arrangement.

With reference now to FIG. 2, a cross sectional view of the dispensing container 10 of the present invention is provided. The constructional details of the interfitting joint 16 are clearly depicted. Outer door 24, inner door 26, and counterweight 28 are all rigidly connected to a pivot rod 30 for rotation therewith. Pivot rod 30 is mounted for rotation adjacent aperture 22. The outer door 24 and inner door 26 form an acute included angle therebetween. A hemispherical shroud 32 surrounds the aperture 22, outer door 24, inner door 26, counterweight 28 and pivot rod 30. This shroud prevents the various numbered elements 18 or 20 from interfering with the operation of the pivotal dispensing mechanism. The outer door 24 is provided with a lip 34 which, when the door is in a closed position, engages the outer surface of the hemispherical shell 12. The inner door 26 is pivoted to an open position when the outer door is in a closed position, allowing the numbered elements 18 or 20 to enter the shroud 32.

Figure 3:
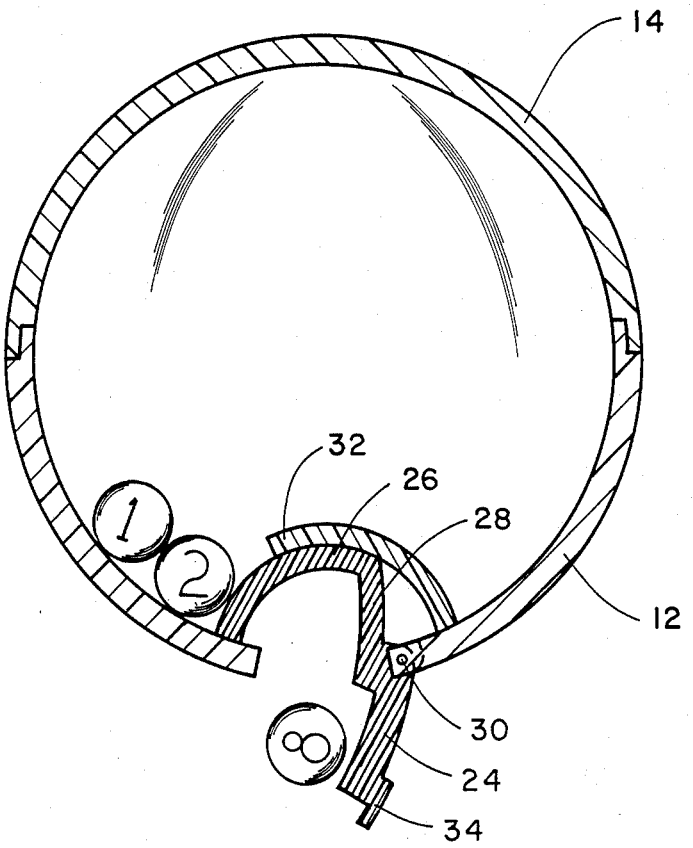
FIG. 3 is a cross sectional view, taken along line 3—3 of FIG. 2, illustrating the hemispherical shroud construction.

FIG. 3 is a cross sectional view similar to FIG. 2, but illustrates the outer door 24 in an open condition and the inner door 26 pivoted to a closed position.

Figure 4:
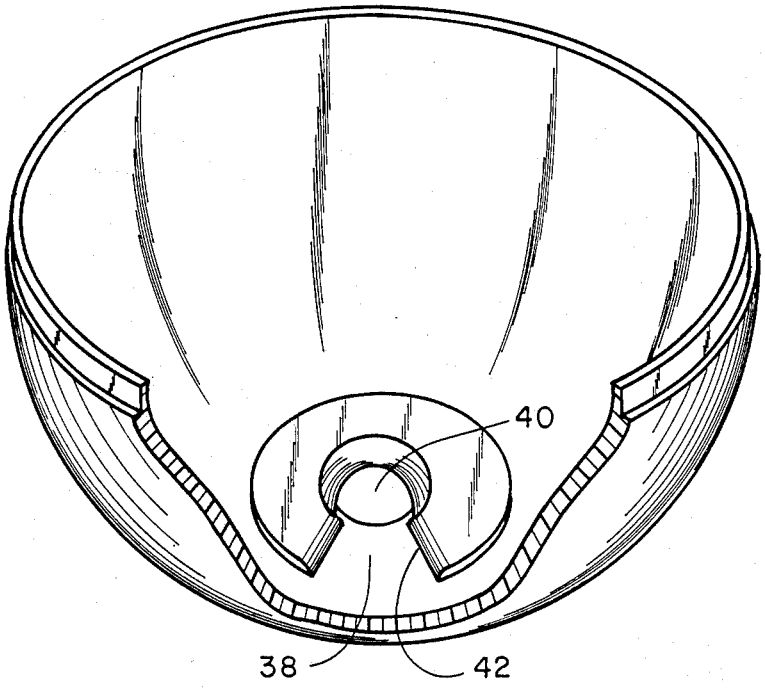
FIG. 4 is a perspective view illustrating the internal shroud construction.

With reference now to FIG. 4, the details of the construction of the hemispherical shroud 32 are illustrated. The shroud 32 is provided with a slot 38 dimensioned for passage of the circular disks 18. The shroud 32 is also provided with an arcuate hole 40 dimensioned for the passage of the spherical balls 20. By utilizing this construction, the dispensing container of the present invention may be utilized with either circular disks 18 or spherical balls 20. The hemispherical shroud 32 is also provided with tapered portions, as at 42, for the purpose of directing numbered spherical balls 20 to the arcuate hole 40.

With reference now to FIG. 1, the operation of the dispensing container 10 of the present invention will now be described. First of all, the hemispherical shells 12 and 14 are separated by pulling them apart, and the numbered elements of the circular disk type 18 or the spherical ball type 20 are inserted. Hemispherical shells 12 and 14 are then joined back together at joint 16. With reference now to FIG. 2, the dispensing container 10 is shown in use with the spherical ball type numbered elements 20. The dispensing container 10 is first shaken, and then inverted. A numbered ball 20 is directed by the tapered portions 42 of the shroud 32 through the hole 40. The ball 20 then rolls onto the inner surface of the outer door 24. It should be noted that the parts are of such a dimension that only one ball 20 at a time may pass through the hole 40. Entry of additional balls is blocked by the presence of the first ball. The weight of the ball 20 overcomes the counterweight 28 and causes the outer door 24 to pivot to an open position, thus dispensing a single ball 20, as shown in FIG. 4. The pivoting of the outer door 24 to an open position concurrently pivots the inner door 26 to a closed position. In this position, the inner door 26 prevents entry of any additional balls 20 through hole 40. The dispensing container 10 is then turned to an upright position. This causes the outer door 24 to pivot back to a closed position. The previously dispensed ball 20 may now be reinserted by opening the outer door 24 by manipulation of the lip 34. Of course, the hemispheres 12 and 14 may be pulled apart for reinsertion of the ball 20, or an additional aperture may be provided for this purpose. The operation is then repeated as many times as desired until the necessary series of numbers has been selected.

The operation of the dispensing container 10 with the circular disk type elements 18 is identical to that described above, with the exception that the disks will pass through the slot 38 in the shroud 32.

The elements of the invention are preferably formed from a plastic material, with the hemispherical shells 12 and 14 formed from a transparent plastic material so as to resemble a crystal ball.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved dispensing container for selecting lottery numbers, comprising:

a generally spherical hollow container means of a size to be held in the palm of a user's hand;

a plurality of numbered element means removably received in said container means;

aperture means in said container means for dispensing said numbered element means;

dispensing door means and means for selectively opening and closing said door means for dispensing said numbered elements one at a time;

said door means comprising a pair of doors which form an acute angle, said doors being rigidly mounted on a rotatable rod mounted adjacent said aperture means; and counterweight means mounted on said pivotal rod.

2. The dispensing container of claim 1, wherein said generally spherical hollow container means is formed by two removably connected hemispherical shells.

3. The dispensing container of claim 1, wherein said plurality of numbered element means comprise a plurality of variously numbered spherical balls.

4. The dispensing container of claim 1, wherein said plurality of numbered element means comprises a plurality of variously numbered circular disks.

5. The dispensing container of claim 1, wherein said generally spherical hollow container means is formed from a transparent plastic material.

6. The dispensing container of claim 1, further comprising a hemispherical shroud on an inner surface of said spherical container means and surrounding said pivotal doors.

7. The dispensing container of claim 6, wherein said hemispherical shroud is provided with slot means and arcuate hole means for alternatively dispensing either circular disks or spherical balls.

8. A new and improved dispensing container for selecting lottery numbers, comprising:

a generally spherical hollow transparent container of a size to be held in the palm of a user's hand;

said container being formed from two hemispherical shells connected by interfitting joint portions;

a plurality of numbered elements in said container;

an aperture for randomly dispensing said numbered elements from said container;

means for randomly dispensing only one of said numbered elements at a time;

said random dispensing means comprising a rod mounted adjacent said aperture for rotary movement about a longitudinal axis;

an outer door having one end rigidly connected to said rod and an opposite end having a lip for engaging an outer wall of said spherical container;

an inner door having one end rigidly connected to said rod and forming an acute angle with said outer door and having an opposite end for engaging an inner wall of said spherical container;

a counterweight rigidly connected to said rod;

a hemispherical shroud on an inner surface of said spherical container surrounding said aperture, said rod, said counterweight, said inner door and said outer door; and said shroud having a slot and an arcuate hole for alternatively dispensing either circular numbered disks or spherical numbered balls through said aperture.

* * * * *